US012454873B2

(12) United States Patent
Gassen et al.

(10) Patent No.: US 12,454,873 B2
(45) Date of Patent: Oct. 28, 2025

(54) HIGH FLOW INSERT SAFETY VALVE THAT IS WELL PRESSURE INSENSITIVE

(71) Applicant: Halliburton Energy Services, Inc., Houston, TX (US)

(72) Inventors: Matthew Gassen, Carrollton, TX (US); James Dan Vick, Jr., Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/924,704

(22) Filed: Oct. 23, 2024

(65) Prior Publication Data

US 2025/0154849 A1 May 15, 2025

Related U.S. Application Data

(60) Provisional application No. 63/598,410, filed on Nov. 13, 2023.

(51) Int. Cl.
*E21B 34/06* (2006.01)

(52) U.S. Cl.
CPC ..... *E21B 34/06* (2013.01)

(58) Field of Classification Search
CPC ... E21B 34/08; E21B 2200/04; F15B 13/0405
See application file for complete search history.

(56) References Cited

U.S. PATENT DOCUMENTS 2,962,099 A * 11/1960 Clark, Jr. ..... E21B 34/08 166/321
4,014,386 A 3/1977 Johnson et al.
4,756,372 A * 7/1988 Airey ..... E21B 34/14 166/373
4,944,350 A * 7/1990 Airey ..... E21B 23/006 166/325
5,193,495 A 3/1993 Wood, III
5,829,952 A * 11/1998 Shadden ..... F16K 15/021 417/547
9,631,456 B2 4/2017 Vick, Jr. et al.
9,810,039 B2 11/2017 Vick, Jr. et al.
(Continued)

FOREIGN PATENT DOCUMENTS

CN 115727137 A 3/2023

OTHER PUBLICATIONS

International Search Report and Written Opinion for International Patent Application No. PCT/US2024/053280 dated Feb. 10, 2025. PDF file. 8 pages.

(Continued)

*Primary Examiner* — Cathleen R Hutchins

(74) *Attorney, Agent, or Firm* — Scott Richardson; C. Tumey Law Group PLLC

(57) ABSTRACT

An insert valve configured to be installed, at least partially, in a safety valve in a borehole that includes a flow port disposed on an exterior of the insert valve, a poppet configured to control a fluid flow through the flow port, an upper piston rod, disposed uphole from the poppet, configured to move the poppet past at least part of the flow port, and a chamber, disposed downhole from the poppet that includes a chamber pressure, and a lower piston rod coupled to the poppet, where the lower piston rod is configured to exert a chamber piston force on the poppet.

20 Claims, 9 Drawing Sheets

(56) References Cited

U.S. PATENT DOCUMENTS

| | | | |
|---|---|---|---|
| 9,982,510 | B2 | 5/2018 | Vick, Jr. et al. |
| 10,030,475 | B2 | 7/2018 | Vick, Jr. |
| 10,113,392 | B2 | 10/2018 | Vick, Jr. et al. |
| 10,920,529 | B2 | 2/2021 | Mailand et al. |
| 10,941,634 | B2 | 3/2021 | Vick, Jr. |
| 10,989,020 | B2 | 4/2021 | Vick, Jr. |
| 11,131,161 | B2 | 9/2021 | Fripp et al. |
| 11,180,974 | B2 | 11/2021 | Vick, Jr. et al. |
| 11,661,820 | B2 | 5/2023 | Dusterhoft et al. |
| 2003/0034158 | A1 | 2/2003 | Lee |
| 2009/0090501 | A1 | 4/2009 | Hansen et al. |
| 2010/0025045 | A1 | 2/2010 | Lake et al. |
| 2013/0032355 | A1 | 2/2013 | Scott et al. |
| 2013/0032356 | A1 | 2/2013 | Scott et al. |
| 2014/0000870 | A1 | 1/2014 | Vick, Jr. et al. |
| 2015/0218907 | A1 | 8/2015 | Vick, Jr. |
| 2016/0060996 | A1 | 3/2016 | Patterson |
| 2016/0258250 | A1 | 9/2016 | Vick, Jr. et al. |
| 2016/0273304 | A1 | 9/2016 | Vick, Jr. et al. |
| 2018/0002886 | A1 | 1/2018 | Cress et al. |
| 2019/0353008 | A1 | 11/2019 | Lake |
| 2019/0360292 | A1 | 11/2019 | Boyd et al. |
| 2020/0063518 | A1 | 2/2020 | Fripp et al. |
| 2020/0095843 | A1 | 3/2020 | Vick, Jr. et al. |
| 2020/0240236 | A1 | 7/2020 | Cress et al. |
| 2020/0308925 | A1 | 10/2020 | Pivowar et al. |
| 2020/0308932 | A1 | 10/2020 | Vick, Jr. |
| 2020/0392811 | A1 | 12/2020 | Vick, Jr. et al. |
| 2020/0392812 | A1 | 12/2020 | Vick, Jr. et al. |
| 2022/0205338 | A1 | 6/2022 | Dusterhoft et al. |
| 2023/0037547 | A1 | 2/2023 | Newton |

OTHER PUBLICATIONS

Schlumberger, GeoGuard high-performance deepwater safety valves, 2021.

International Search Report and Written Opinion for International Patent Application No. PCT/US2023/086481 dated Apr. 26, 2024. PDF file. 8 pages.

International Search Report and Written Opinion for International Patent Application No. PCT/US2023/086241 dated Sep. 3, 2024. PDF file. 8 pages.

* cited by examiner

HIGH FLOW INSERT SAFETY VALVE THAT IS WELL PRESSURE INSENSITIVE

CROSS REFERENCE TO RELATED APPLICATIONS

This is a nonprovisional application claiming priority to U.S. Provisional Patent Application No. 63/598,410, filed Nov. 13, 2023, the entirety of which is incorporated herein by reference.

BACKGROUND

The oil and gas industry may use borehole as fluid conduits to access subterranean deposits of various fluids and minerals which may include hydrocarbons. A drilling operation may be utilized to construct the fluid conduits which are capable of producing hydrocarbons disposed in subterranean formations. Borehole may be constructed, in increments, as tapered sections, which sequentially extend into a subterranean formation.

A safety valve may be installed to prevent the undesired flow of fluids (e.g., oil, gas, etc.) from a reservoir, up through the borehole, and to the surface. The safety valve may be "normally closed" so that a flapper (or other component thereof) is under passive, uncontrolled, and/or constant force (e.g., via a torsion spring) to move the flapper to the closed position. Thus, in order to open the safety valve, active control (e.g., hydraulic piston) is required to counteract the constant force applied to the flapper. Accordingly, in an emergency situation, hydraulic pressure on the flapper may be quickly removed (if not already released) and the safety valve will automatically close by its own mechanism. Consequently, flow from the reservoir will cease and the emergency situation at the surface may be handled accordingly.

BRIEF DESCRIPTION OF DRAWINGS

These drawings illustrate certain aspects of some examples of the present disclosure and should not be used to limit or define the disclosure.

DETAILED DESCRIPTION

Overview and Advantages

Figure 1:
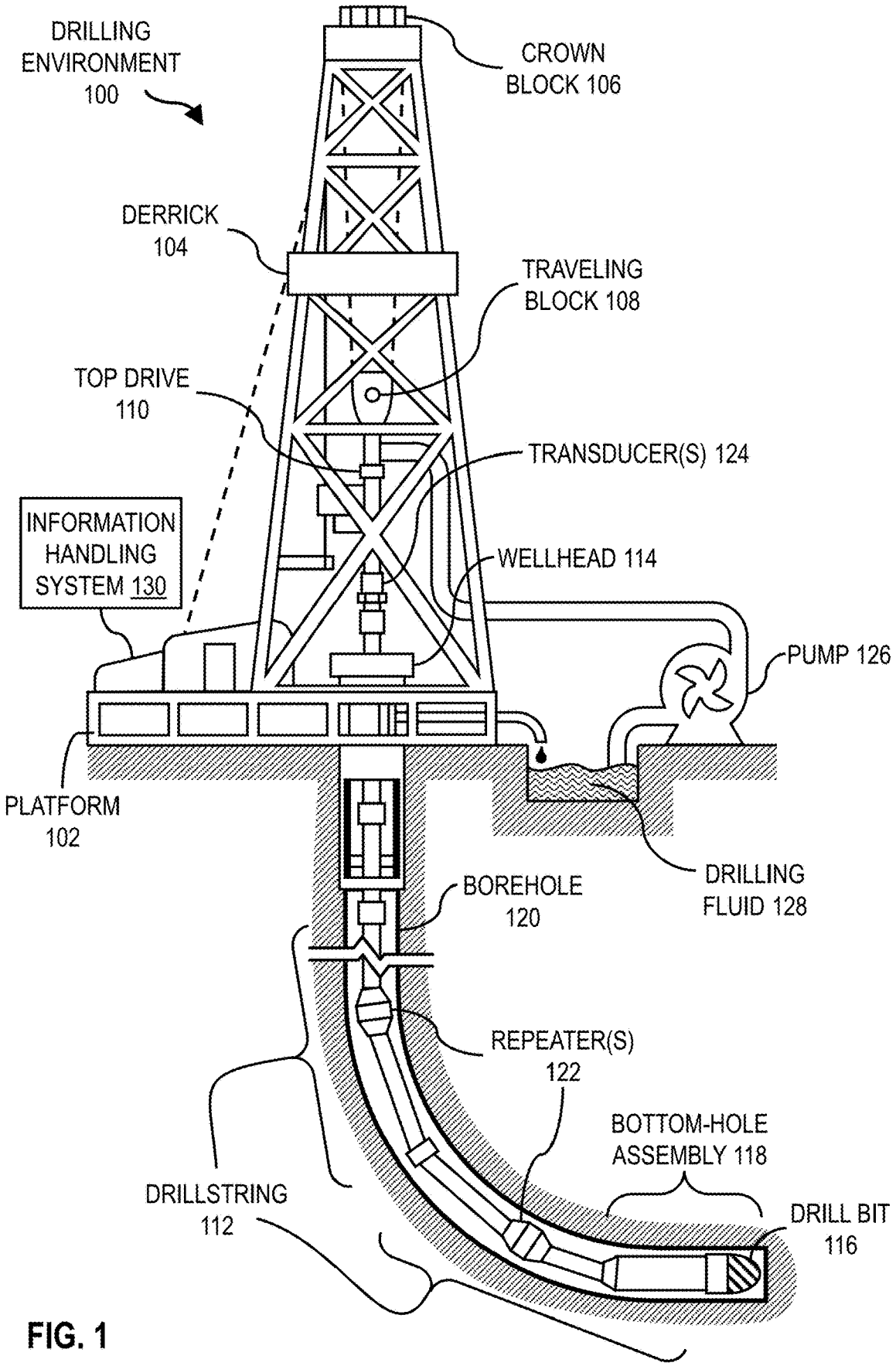
FIG. 1 is a diagram of an example drilling environment.

In general, this application discloses one or more embodiments of methods and systems for an insert valve, installed in an insert valve, which allows for improved fluid flow and control.

In boreholes, a safety valve may be installed to prevent the undesired flow of fluids (e.g., oil, gas, etc.) from a reservoir, up through the borehole, and to the surface. The safety valve may be "normally closed" so that a flapper (or other component thereof) is under passive, uncontrolled, and/or constant force (e.g., via a torsion spring) to move the flapper to the closed position. Thus, in order to open the safety valve, active control is required to counteract the constant force applied to the flapper (e.g., via a hydraulic piston). Accordingly, in an emergency situation, hydraulic pressure on the flapper may be quickly removed (if not already released) and the safety valve will automatically close by its own mechanism. Consequently, flow from the reservoir will cease and the emergency situation at the surface may be handled accordingly.

However, as the safety valve is repeatedly opened and closed (e.g., via a hydraulic piston), the safety valve's internal components may "wear" and not operate as efficiently as designed. Specifically, the flapper (or other closure mechanism) of the safety valve may not close fully (e.g., the spring may have lost some of its ability to keep tension). Consequently, fluids may partially flow around the flapper, even when the safety valve is "closed". Such performance is undesirable as the uncontrolled flow of a reservoir's fluids, even if minimal, may exacerbate an emergency situation at the surface.

When a safety valve loses its ability to properly control the flow of a reservoir's fluid, an insert valve may be installed inside the safety valve, in parallel, to restore proper reservoir fluid control. However, there are several drawbacks from the use of an insert valve.

A first drawback of an insert valve is that the flow rate from the borehole is reduced as the additional components of the insert valve consume volume of the flow path inside the original safety valve. A second drawback is that insert valves are often equipped with similar spring and flapper mechanisms that are prone to the same wear as the original safety valve. Further, at certain depths it becomes impractical, if not impossible, to fabricate a spring capable of overcoming the hydrostatic head (from the weight of the column of liquid in the borehole). A third drawback is that conventional insert valves (as well as other types of valves) often have complicated designs and hydraulic control mechanisms requiring the addition of multiple seals, each of which is prone to wear and leaks.

As disclosed herein, an insert valve is provided that allows for fluid flow greater than conventional insert valves by allowing fluid to flow around the closure mechanism then into the internal volume of the insert valve. The piston that controls the closure is constructed in-line and centered with the closure mechanism. Additionally, the piston (and the hydraulic controls therefor) are disposed uphole from the closure mechanism thereby minimizing the number of hydraulic seals installed in the insert valve.

FIG. 1

FIG. 1 is a diagram of an example drilling environment. Drilling environment 100 may include platform 102 that supports derrick 104 and crown block 106 thereon to enable use of traveling block 108 for raising and lowering top drive 110 and drillstring 112. Top drive 110 supports and rotates drillstring 112 as it is lowered through wellhead 114. In turn, drill bit 116 (disposed on bottom-hole assembly 118 at the end of drillstring 112), may create borehole 120. Each of these components is described below.

Platform 102 is a structure which may be used to support one or more other components of drilling environment 100 (e.g., derrick 104). Platform 102 may be designed and constructed from suitable materials (e.g., concrete) which are able to withstand the forces applied by other components (e.g., the weight and counterforces experienced by derrick 104). In any embodiment, platform 102 may be constructed to provide a uniform surface for drilling operations in drilling environment 100.

Derrick 104 is a structure which may support, contain, and/or otherwise facilitate the operation of one or more pieces of the drilling equipment. In any embodiment, derrick 104 may provide support for crown block 106, traveling block 108, and/or any part connected to (and including) drillstring 112. Derrick 104 may be constructed from any suitable materials (e.g., steel) to provide the strength necessary to support those components.

Crown block 106 is one or more simple machines which may be rigidly affixed to derrick 104 and include a set of pulleys (e.g., a "block"), threaded (e.g., "reeved") with a drilling line (e.g., a steel cable), to provide mechanical advantage. Crown block 106 may be disposed vertically above traveling block 108 and threaded with the same drilling line.

Traveling block 108 is one or more simple machines which may be movably affixed to derrick 104 and include a set of pulleys, threaded with a drilling line, to provide mechanical advantage. Traveling block 108 may be disposed vertically below crown block 106, where crown block 106 is threaded with the same drilling line. In any embodiment, traveling block 108 may be mechanically coupled to drillstring 112 (e.g., via top drive 110) and allow for drillstring 112 (and/or any component thereof) to be lifted from (and out of) borehole 120. Both crown block 106 and traveling block 108 may use a series of parallel pulleys (e.g., in a "block and tackle" arrangement) to achieve significant mechanical advantage, allowing for the drillstring to handle greater loads (compared to a configuration that uses non-parallel tension). Traveling block 108 may move vertically (e.g., up, down) within derrick 104 via the extension and retraction of the drilling line.

Top drive 110 is a machine which may be configured to rotate drillstring 112. Top drive 110 may be affixed to traveling block 108 and configured to move vertically within derrick 104 (e.g., along with traveling block 108). In any embodiment, the rotation of drillstring 112 (caused by top drive 110) may allow for drillstring 112 to carve borehole 120. Top drive 110 may use one or more motors and gearing mechanisms to cause rotations of drillstring 112. In any embodiment, a rotatory table (not shown) and a "Kelly" drive (not shown) may be used in addition to, or instead of, top drive 110.

Drillstring 112 is a machine which may be used to carve borehole 120 and/or gather data from borehole 120 and the surrounding geology. Drillstring 112 may include one or more drillpipes, bottom-hole assembly 118, and one or more repeaters 122 disposed thereon. Drillstring 112 may rotate (e.g., via top drive 110) to form and deepen borehole 120 (e.g., via drill bit 116) and/or via one or more motors attached to drillstring 112.

Wellhead 114 is a machine which may include one or more pipes, caps, and/or valves to provide pressure control for contents within borehole 120 (e.g., when fluidly connected to a well (not shown)). In any embodiment, during drilling, wellhead 114 may be equipped with a blowout preventer (not shown) to prevent the flow of higher-pressure fluids (in borehole 120) from escaping to the surface in an uncontrolled manner. Wellhead 114 may be equipped with other ports and/or sensors to monitor pressures within borehole 120 and/or otherwise facilitate drilling operations.

Drill bit 116 is a machine which may be used to cut through, scrape, and/or crush (i.e., break apart) materials in the ground (e.g., rocks, dirt, clay, etc.). Drill bit 116 may be disposed at the frontmost point of drillstring 112 and bottom-hole assembly 118. In any embodiment, drill bit 116 may include one or more cutting edges (e.g., hardened metal points, surfaces, blades, protrusions, etc.) to form a geometry which aids in breaking ground materials loose and further crushing that material into smaller sizes. In any embodiment, drill bit 116 may be rotated and forced into (i.e., pushed against) the ground material to cause the cutting, scraping, and crushing action. The rotations of drill bit 116 may be caused by top drive 110 and/or one or more motors located on drillstring 112 (e.g., on bottom-hole assembly 118).

Bottom-hole assembly 118 is a machine which may be equipped with one or more tools for creating, providing structure, and maintaining borehole 120, as well as one or more tools for measuring the surrounding environment (e.g., measurement while drilling (MWD), logging while drilling (LWD)). In any embodiment, bottom-hole assembly 118 may be disposed at (or near) the end of drillstring 112 (e.g., in the most "downhole" portion of borehole 120).

Non-limiting examples of tools that may be included in bottom-hole assembly 118 include a drill bit 116, casing tools (e.g., a shifting tool), a plugging tool, a mud motor, a drill collar (thick-walled steel pipes that provide weight and rigidity to aid the drilling process), actuators (and pistons attached thereto), a steering system, and any measurement tool (e.g., sensors, probes, particle generators, etc.).

Further, bottom-hole assembly 118 may include a telemetry sub to maintain a communications link with the surface (e.g., optionally via repeaters 122 and transducers 124 to information handling system 130). Such telemetry communications may be used for (i) transferring tool measurement data from bottom-hole assembly 118 to surface receivers, and/or (ii) receiving commands (from the surface) to bottom-hole assembly 118 (e.g., for use of one or more tools in bottom-hole assembly 118).

Non-limiting examples of techniques for transferring tool measurement data (to the surface) include mud pulse telemetry and through-wall acoustic signaling. For through-wall acoustic signaling, one or more repeaters 122 may detect, amplify, and re-transmit signals from bottom-hole assembly 118 to the surface (e.g., to information handling system 130), and conversely, from the surface (e.g., from information handling system 130) to bottom-hole assembly 118.

Borehole 120 is a hole in the ground which may be formed by drillstring 112 (and one or more components thereof). Borehole 120 may be partially or fully lined with casing to protect the surrounding ground from the contents of borehole 120, and conversely, to protect borehole 120 from the surrounding ground.

Repeater 122 is a device which may be used to receive and send signals from one component of drilling environment 100 to another component of drilling environment 100. As a non-limiting example, repeater 122 may be used to receive a signal from a tool on bottom-hole assembly 118 and send that signal to transducer 124 (or directly to information handling system 130). Two or more repeaters 122 may be used together, in series, such that a signal to/from bottom-hole assembly 118 may be relayed through two or more repeaters 122 before reaching its destination.

Transducer 124 is a device which may be configured to convert non-digital data (e.g., vibrations, other analog data) into a digital form suitable for information handling system 130. As a non-limiting example, one or more transducers 124 may convert signals between mechanical and electrical forms, enabling information handling system 130 to receive the signals from a telemetry sub, on bottom-hole assembly 118, and conversely, transmit a downlink signal to the telemetry sub on bottom-hole assembly 118. In any embodiment, transducer 124 may be located at the surface and/or any part of drillstring 112 (e.g., as part of bottom-hole assembly 118).

Pump 126 is a machine that may be used to circulate drilling fluid 128 in borehole 120. In one or more embodiments, pump 126 circulates drilling fluid 128 from a reservoir, through a feed pipe, to derrick 104, to the interior of drillstring 112, out through drill bit 116 (through orifices, not shown), upward through borehole 120 in an annulus around drillstring 112, and back into the reservoir. In any embodiment, any type of pump 126 may be used (e.g., centrifugal, gear, etc.) which is powered by any suitable means (e.g., electricity, combustible fuel, etc.).

Drilling fluid 128 is a liquid which may be pumped through drillstring 112 and borehole 120 to collect drill cuttings, debris, and/or other ground material from the end of borehole 120 (e.g., the volume most recently hollowed by drill bit 116). Further, drilling fluid 128 may provide conductive cooling to drill bit 116 (and/or bottom-hole assembly 118). In any embodiment, drilling fluid 128 may be circulated via pump 126 and filtered to remove unwanted debris.

Information handling system 130 is a hardware computing system which may be operatively connected to drillstring 112 (and/or other various components of the drilling environment). In any embodiment, information handling system 130 may utilize any suitable form of wired and/or wireless communication to send and/or receive data to and/or from other components of drilling environment 100. In any embodiment, information handling system 130 may receive a digital telemetry signal, demodulate the signal, display data (e.g., via a visual output device), and/or store the data. In any embodiment, information handling system 130 may send a signal (with data) to one or more components of drilling environment 100 (e.g., to control one or more tools on bottom-hole assembly 118).

In any embodiment, information handling system 130 may be utilized to perform various steps, methods, and techniques disclosed herein (e.g., via the execution of software). In any embodiment, information handling system 130 may include one or more processors, cache, memory, storage, and/or one or more peripheral devices. Any two or more of these components may be operatively connected via a system bus that provides a means for transferring data between those components.

FIGS. 2A-2D

Figure 2A:
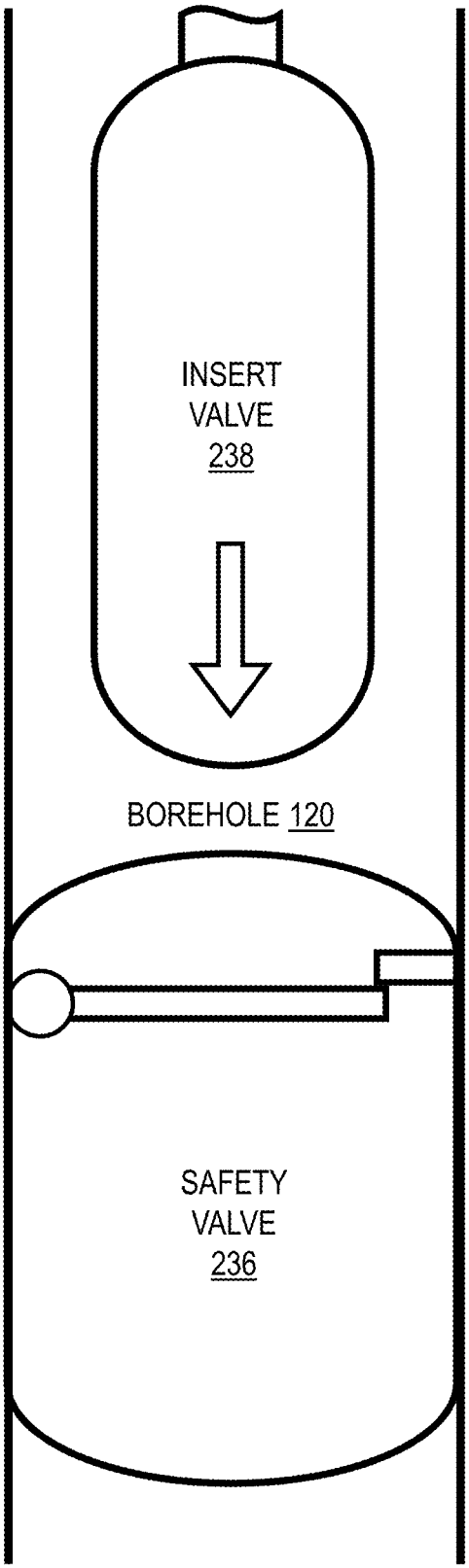
FIG. 2A is a diagram of an insert valve approaching a safety valve in a borehole.
Figure 2B:
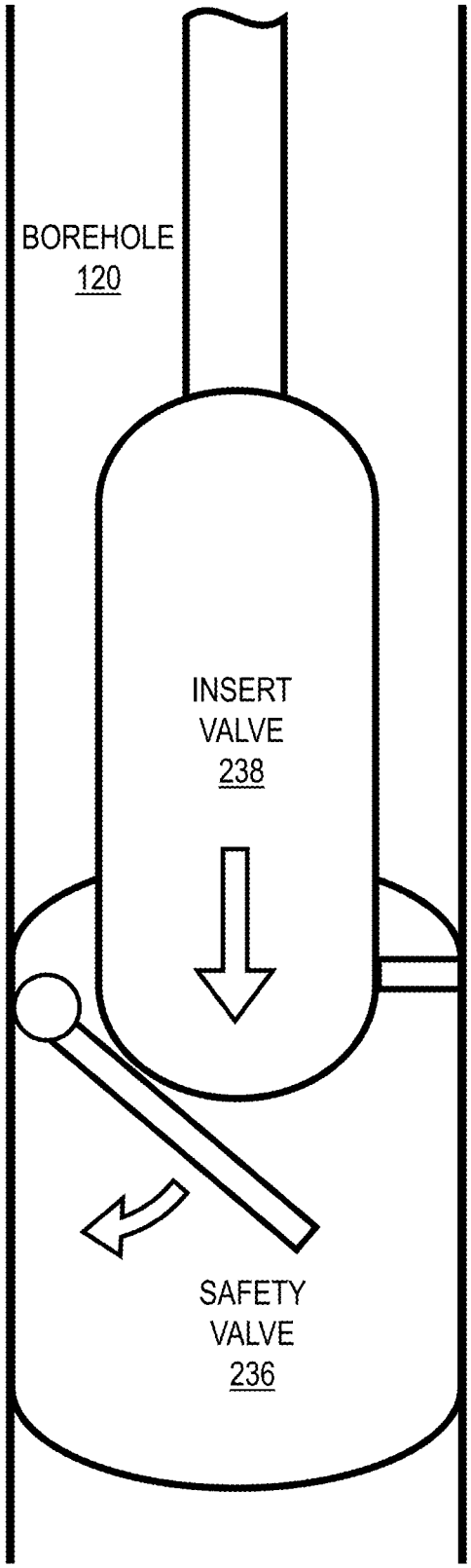
FIG. 2B is a diagram of an insert valve while partially proceeding into a safety valve.
Figure 2C:
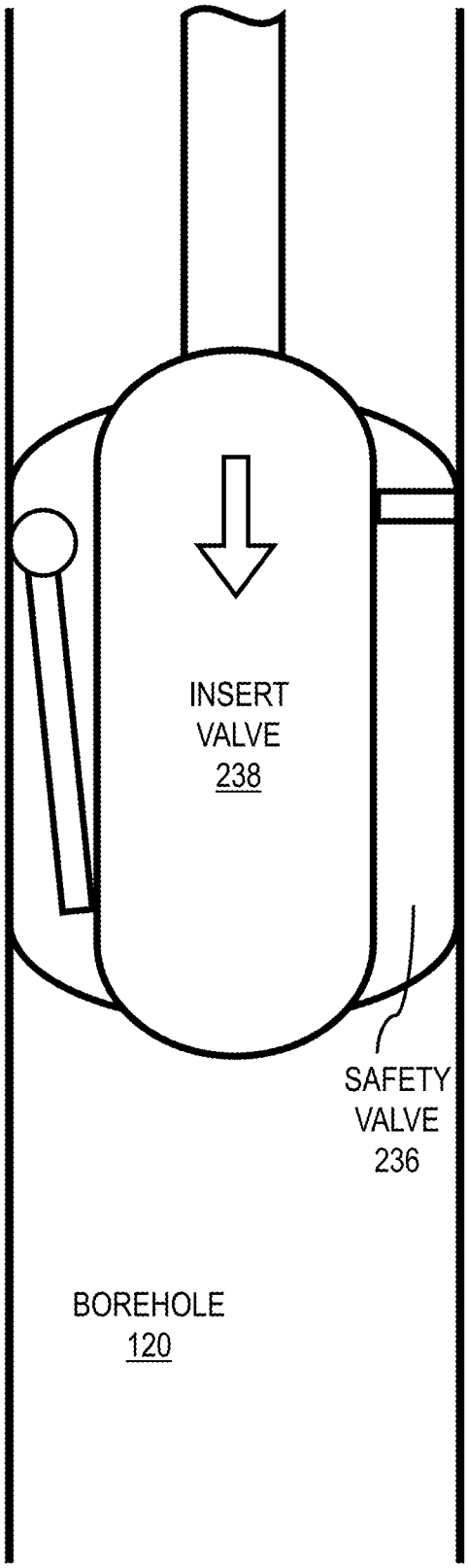
FIG. 2C is a diagram of an insert valve installed in a safety valve, prior to removal of the drillstring.
Figure 2D:
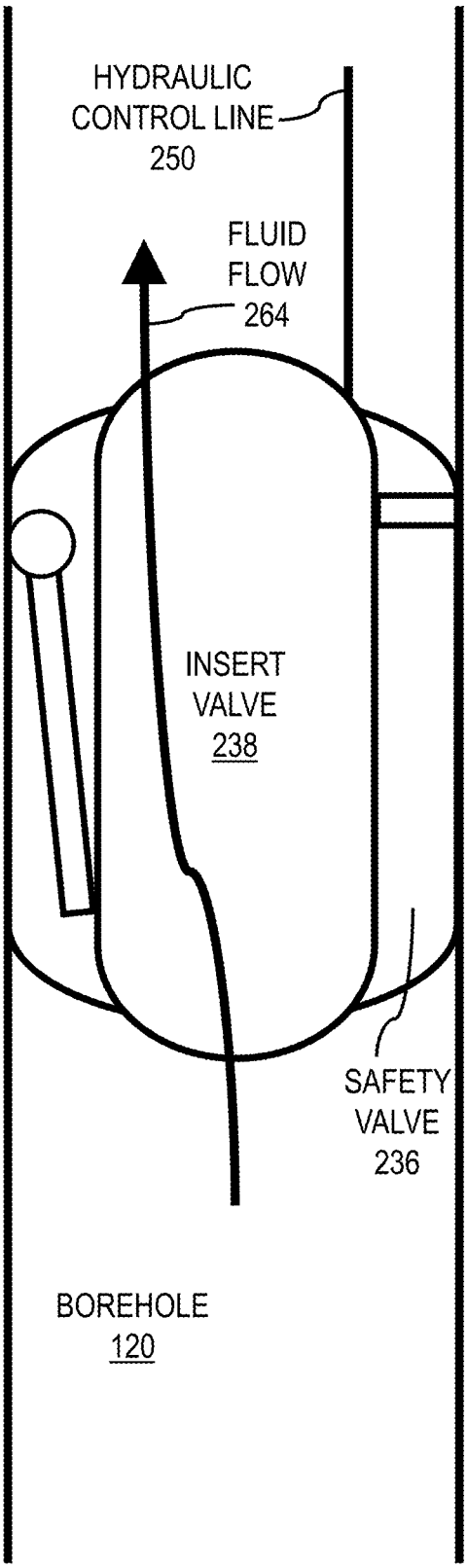
FIG. 2D is a diagram of an insert valve installed in a safety valve with fluid flow.

FIG. 2A is a diagram of an insert valve approaching a safety valve in a borehole. FIG. 2B is a diagram of an insert valve while partially proceeding into a safety valve. FIG. 2C is a diagram of an insert valve installed in a safety valve, prior to removal of the drillstring. FIG. 2D is a diagram of an insert valve installed in a safety valve with fluid flow.

Safety valve 236 is a fail-safe valve that prevents the uncontrolled and/or undesired flow of fluids from a reservoir up through borehole 120. Safety valve 236 may be equipped with a spring-loaded flapper that may be forced open (e.g., via a hydraulic piston) and allow for the flow of fluids. When not held open, the flapper tends to the "closed" position and prevents the flow of fluids from proceeding up borehole 120. In any embodiment, safety valve 236 is installed within a casing of borehole 120.

The flapper of a safety valve 236 may wear over time (e.g., due to repeated opening/closing) and not fully close, consequently some fluids may leak through the flapper even when that flapper is not held open. To better control the flow of fluids when safety valve 236 becomes leaky, insert valve 238 may be installed in safety valve to better control the flow of fluid through borehole 120.

Insert valve 238, like safety valve 236, is a fail-safe valve that prevents the uncontrolled and/or undesired flow of fluids from a reservoir up through borehole 120. However, unlike safety valve 236, insert valve 238 is configured to be installed inside safety valve 236. In any embodiment, insert valve 238 may be installed in safety valve 236 by wireline, and/or any other apparatus capable of detachably holding and lowering insert valve 238. After insert valve 238 is installed in safety valve 236, the wireline (and/or some other apparatus) may be detachably removed from insert valve 238.

Hydraulic control line 250 is a hose, tube, and/or other conduit which carries hydraulic fluid. In any embodiment, hydraulic control line 250 carries hydraulic fluid between the surface and hydraulic control port 448 (insert valve 238 may be in hydraulic contact with hydraulic control line 250, generally). In any embodiment, hydraulic fluid may be pumped (i.e., hydraulic flow 466) into hydraulic control line 250, to hydraulic control port 448, and into upper piston bore 346U. In turn, the hydraulic fluid pumped into upper piston bore 346U causes piston rod 344 to translate towards poppet 354.

Fluid flow 264 is the movement of fluid (e.g., oil, gas, etc.) from a reservoir up through borehole 120, into and through insert valve 238, and up to the surface. Fluid flow 264 may be controlled (e.g., prevented, slowed, allowed) by one or more valves (e.g., safety valve 236, insert valve 238, wellhead 114).

FIGS. 3A-3B

Figure 3A:
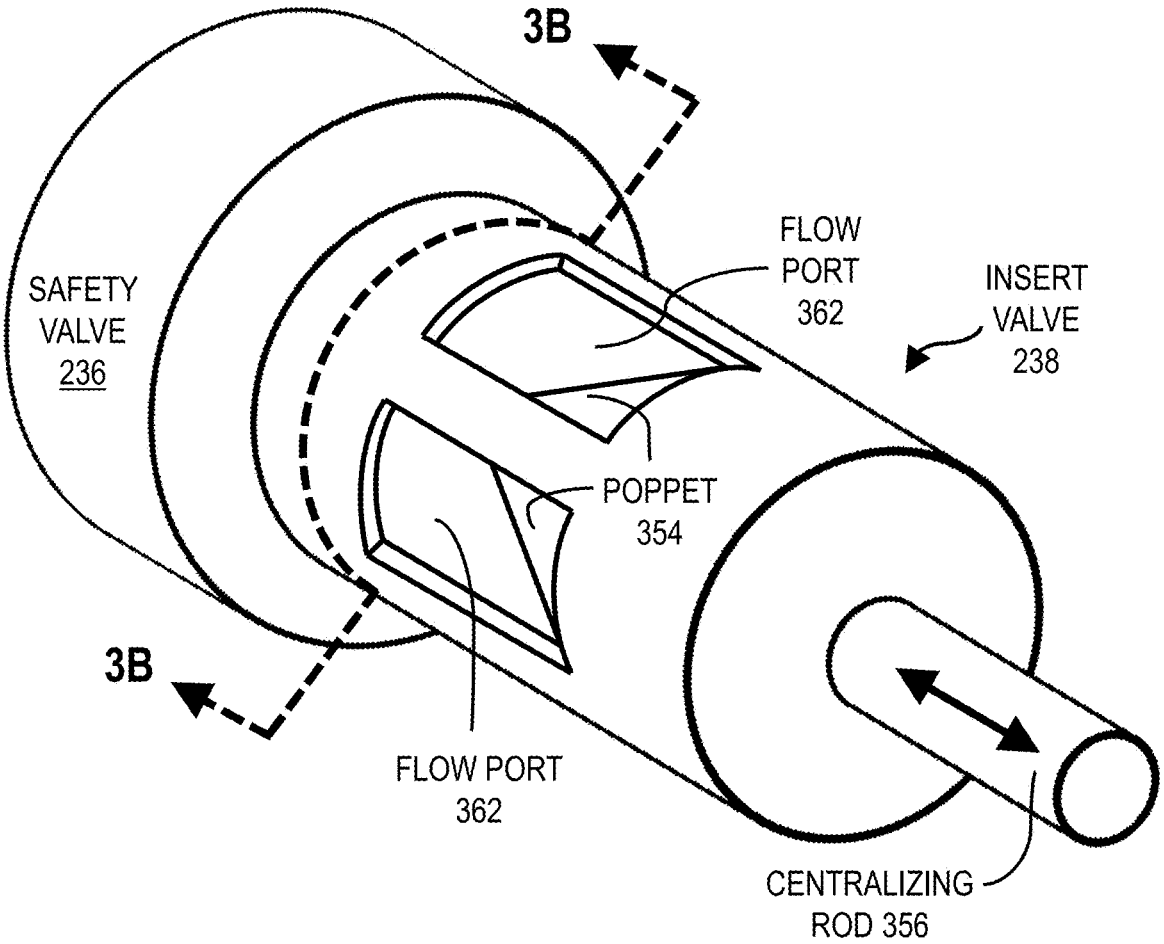
FIG. 3A is a diagram of an insert valve installed in a safety valve.
Figure 3B:
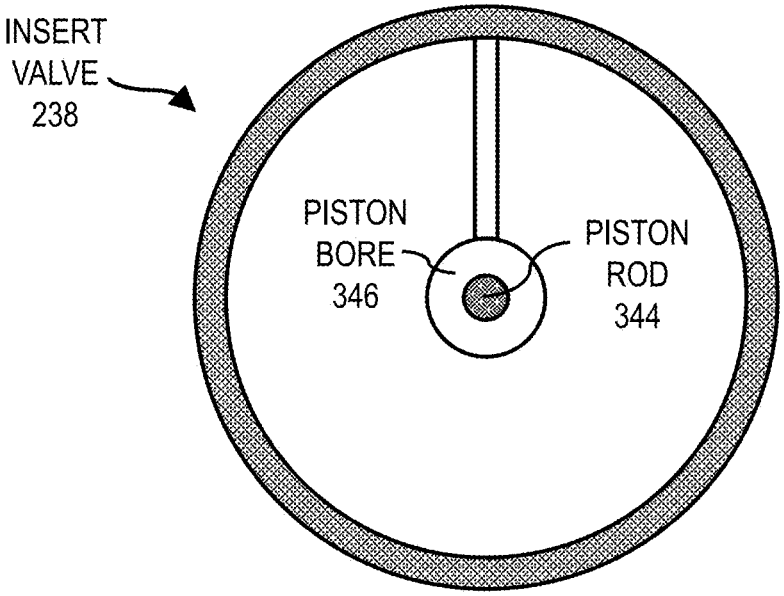
FIG. 3B is a cutaway view of an insert valve facing uphole.

FIG. 3A is a diagram of an insert valve installed in a safety valve. FIG. 3B is a cutaway view of an insert valve facing uphole.

Figure 4A:
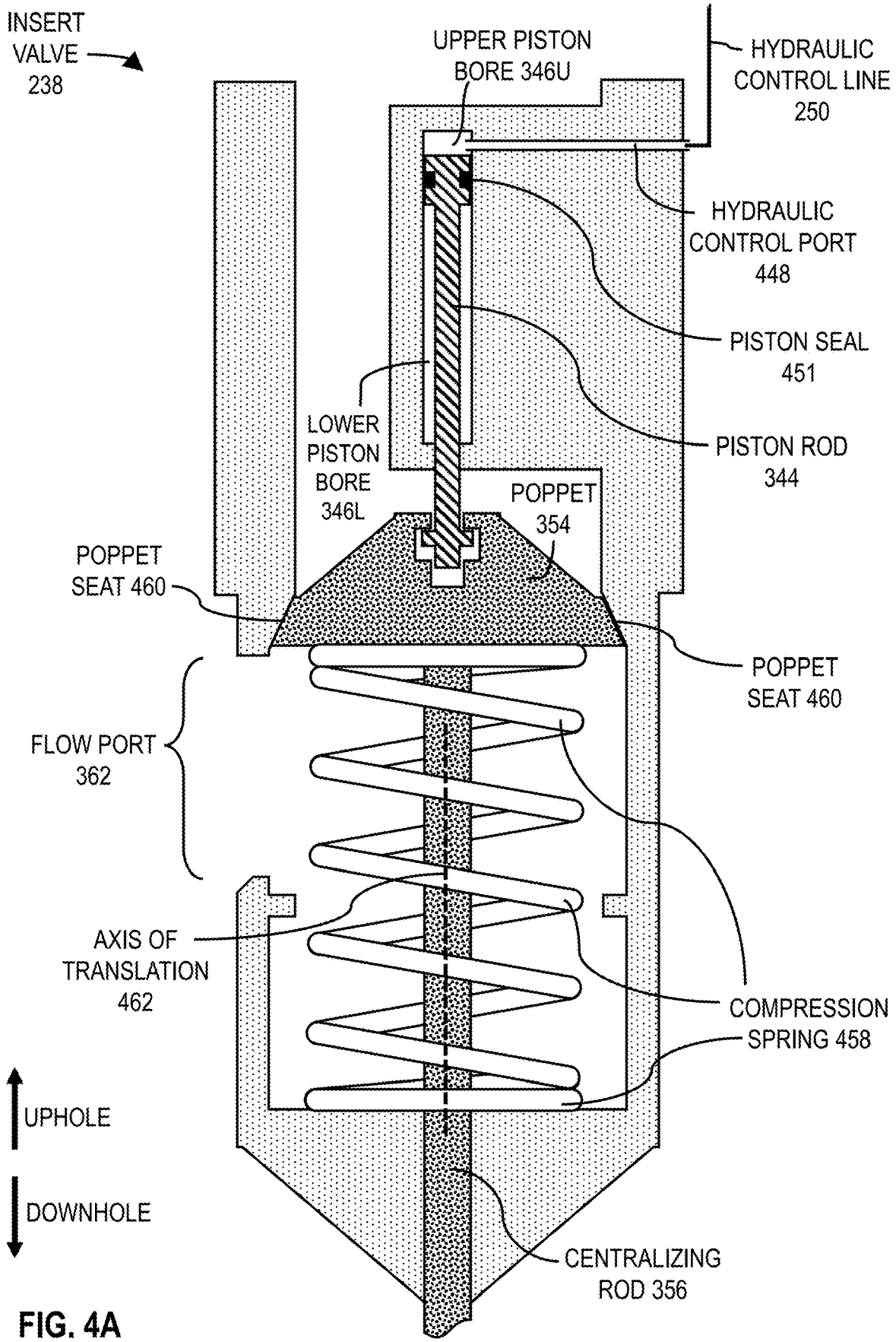
FIG. 4A is a diagram of an insert valve in a closed position.

Piston rod 344 is a rigid structure used to translate force and/or pressure to another body. In any embodiment, piston rod 344 may be controlled to move via hydraulics (e.g., from hydraulic control port 448 and hydraulic control line 250). As shown in FIG. 4A, piston rod 344 may be used to translate force to poppet 354. In any embodiment, piston rod 344 may translate at least partially within piston bore 346. Piston rod 344 may include one or more sections with larger diameter which are used to isolate volumes around different sections of piston rod 344 (within piston bore 346). In any embodiment, piston rod 344 may translate along axis of translation 462.

Piston bore 346, generally, is volume that surrounds at least a portion of piston rod 344. In any embodiment, piston bore 346 includes one or more volumes (e.g., upper piston bore 346U, lower piston bore 346L) that are isolated from volumes which surround piston bore 346 (e.g., the internal volume of insert valve 238). Piston seal 451 may divide piston bore 346 into two internal volumes that are isolated from each other (e.g., upper piston bore 346U, lower piston bore 346L).

Upper piston bore 346U is volume into which piston rod 344 may translate and is in fluid connection with hydraulic control port 448. Piston seal 451 may separate the volume of upper piston bore 346U on one side. In any embodiment, upper piston bore 346U is isolated from the internal volume of insert valve 238 and therefore may have a different pressure within the volume (i.e., that of hydraulic control port 448).

Lower piston bore 346L is volume into which piston rod 344 may translate. In one or more embodiments, lower piston bore 346L is in fluid contact with the internal volume of insert valve 238. Alternatively, in one or more embodiments, lower piston bore 346L may be isolated from the internal volume of insert valve 238 by one or more piston seals (not shown). Piston seal 451 may separate the volume of lower piston bore 346L on one side from upper piston bore 346U.

Figure 4B:
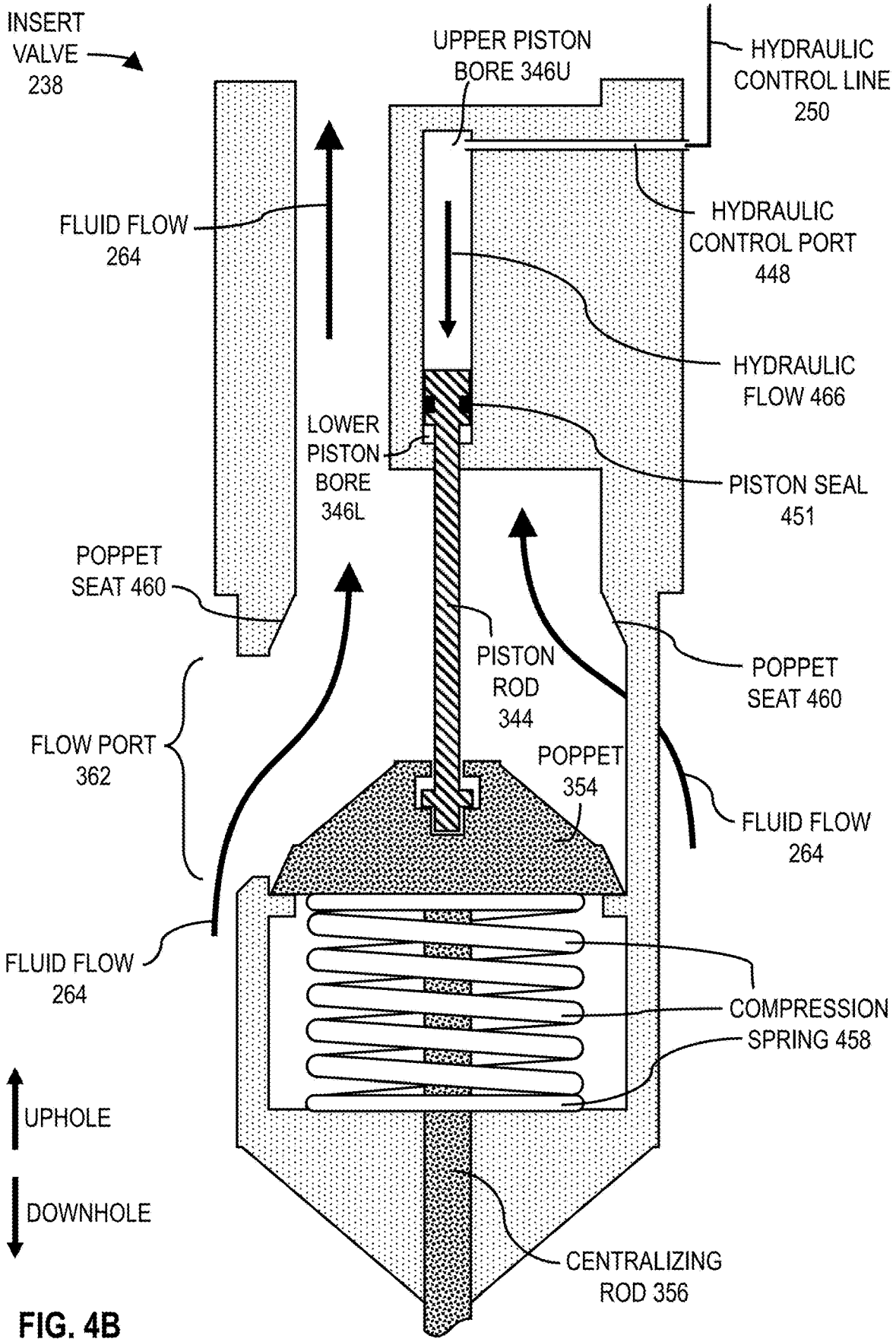
FIG. 4B is a diagram of an insert valve in an open position.

Poppet 354 is a rigid body which may be configured to control (i.e., translate to "open" or "close") insert valve 238 into an "open position" and "closed position", respectively. In any embodiment, poppet 354 translates within the internal volume of insert valve 238 past flow port 362. When poppet 354 is in the "open position" (as shown in FIG. 3A and FIG. 4B), poppet 354 is moved further downhole (by piston rod 344) allowing fluid flow 264 through flow port 362. When poppet 354 is in the "closed position" (as shown in FIG. 4A), poppet 354 may be pressed against poppet seat 460 thereby preventing fluid flow 264 of borehole fluids into insert valve 238. In any embodiment, poppet 354 may translate along axis of translation 462.

Centralizing rod 356 is a rigid body, affixed to poppet 354, which is used to keep poppet 354 aligned with piston rod 344 and insert valve 238, generally. Centralizing rod 356 may slide through an opening (e.g., hole) at the downhole end of insert valve 238. The opening through which centralizing rod 356 translates may be sufficiently lengthy to prevent poppet 354 (and centralizing rod 356) from pivoting away from the axis of translation 462. In any embodiment, centralizing rod 356 may translate along axis of translation 462.

Flow port 362 is a hole in insert valve 238 which allows for fluid flow 264 when poppet 354 is in the "open" position. In one or more embodiments, flow port 362 is disposed on an exterior of insert valve 238. Insert valve 238 may have one or more flow ports 362 disposed around the circumference of the body. When insert valve 238 is in the "closed" position, flow port 362 is exposed to the underside (or side) of poppet 354 and fluid flow 264 is prevented as there is no pathway from below insert valve 238 to the internal volume of insert valve 238.

FIGS. 4A-4B

FIG. 4A is a diagram of an insert valve in a closed position. FIG. 4B is a diagram of an insert valve in an open position.

Hydraulic control port 448 is an opening and/or passage through which hydraulic fluid may be pumped (e.g., from hydraulic control line 250). In any embodiment, hydraulic control port 448 may be built into insert valve 238 (e.g., drilled) with a hole exposed on an exterior surface of the body. The exposed hole may be connected to hydraulic control line 250 to allow for the passage of hydraulic fluids from hydraulic control line 250 and into hydraulic control port 448. On the other end, hydraulic control port 448 opens to upper piston bore 346U.

Piston seal 451 is an apparatus that circumscribes around piston rod 344 and may have a larger diameter. In any embodiment, piston seal 451 acts to isolate piston bore 346 into two volumes (e.g., upper piston bore 346U from a volume below). Accordingly, in any embodiment, upper piston bore 346U may be filled with pressurized hydraulic fluid as piston seal 451 prevents (or limits) hydraulic fluid from leaking into the internal volume of insert valve 238. Conversely, the internal volume of insert valve 238 may be filled with pressurized fluids (e.g., oil) and piston seal 451 prevents (or limits) the flow of the pressurized fluid into upper piston bore 346U.

Compression spring 458 (i.e., "spring"). is a machine that provides constant tension between two bodies. In any embodiment, compression spring 458 may function by tending to an extended state while allowing elastic compression. Thus, when compressed, compression spring 458 exerts outward force (i.e., tension) on the bodies that are exerting inward forces (i.e., compression) on compression spring 458. In any embodiment, compression spring 458 may be used to assist poppet 354 into poppet seat 460 and keep force thereon (e.g., compression spring 458 exerts an "upward force" on poppet 354). In any embodiment, compression spring 458 may be centered around axis of translation 462.

Poppet seat 460 is a structure of the internal volume of insert valve 238 that forms a seal with poppet 354. In any embodiment, poppet seat 460 may take the form of a tapered wall with geometry that is complementary to at least a portion of poppet 354. Thus, when poppet 354 is mated to poppet seat 460, a seal is formed between the corresponding geometries that sufficiently prevents fluid flow 264.

Axis of translation 462 is the axis along which piston rod 344, poppet 354, and centralizing rod 356 may translate. In any embodiment, axis of translation 462 may be placed centered (or relatively close to) within insert valve 238.

Hydraulic flow 466 is the flow of hydraulic fluid between piston bore 346 and the surface via hydraulic control port 448 and hydraulic control line 250. Hydraulic flow 466 may be manually controlled at the surface (e.g., by an operator) to initiate the movement of piston rod 344 and poppet 354 to open insert valve 238. Hydraulic flow 466 may go in either direction depending on the pressure pumped into hydraulic control line 250. When hydraulic fluid is pumped into hydraulic control line 250, hydraulic flow 466 proceeds from the surface to upper piston bore 346U. When the pressure if released from hydraulic control line 250 (i.e., pumping is stopped the hydraulic fluid is allowed to flow back to the surface), hydraulic flow 466 proceeds from upper piston bore 346U to the surface.

FIG. 5

Figure 5:
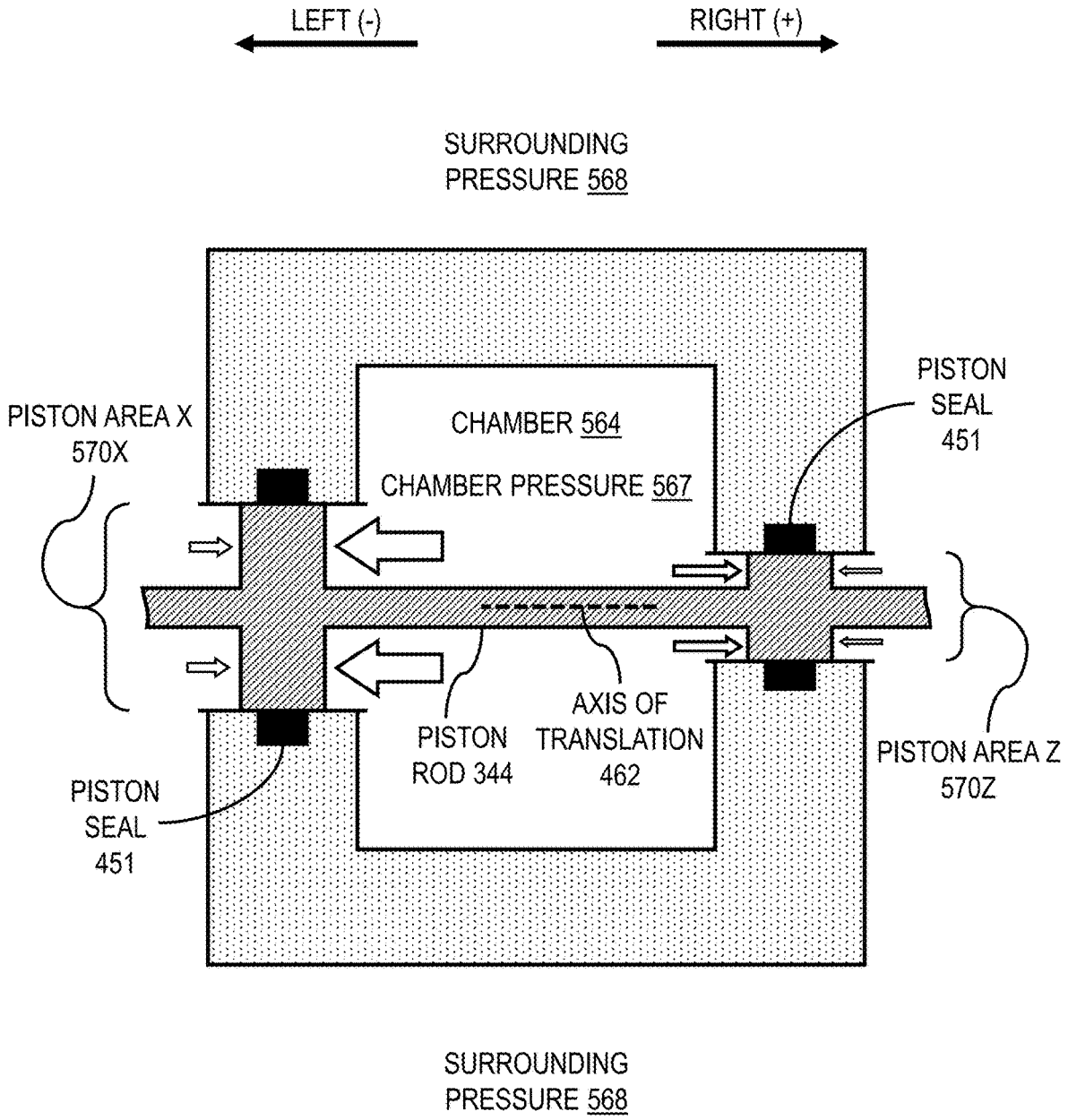
FIG. 5 is a diagram of an example chamber showing forces on a piston disposed therethrough.

FIG. 5 is a diagram of an example chamber showing forces on a piston disposed therethrough.

Chamber 564 is a volume which may be in fluid contact with piston rod 344 and the internal piston areas thereof (e.g., the internally facing piston area X 570X and piston area Z 570Z). In any embodiment, chamber 564 may be "pre-charged" and filled with a gas (or gas-liquid combination) to maintain a (relatively) constant chamber pressure 567. Chamber 564 may include two openings, through which piston rod 344 may be disposed. The two openings in chamber 564 (through which piston rod 344 are disposed) may have sizes each corresponding to piston area X 570X and piston area Z 570Z, respectively. Further, each opening in chamber 564 may include one or more piston seals 451.

Chamber pressure 567 is the pressure inside chamber 564. In one or more embodiments, chamber pressure 567 may be the less than, the same as, or greater than surrounding pressure 568. Chamber pressure may be set (e.g., controlled, charged, etc.) to a preset value (e.g., an absolute pressure of 1,000 psi) and then disposed in a desired location (e.g., downhole in borehole 120 as part of insert valve 238). In embodiments where chamber pressure 567 is different (i.e., greater or less than) surrounding pressure 568 and piston area X 570X is different (i.e., larger or smaller) than piston area Z 570Z, a chamber piston force (along axis of translation 462) will exist on piston rod 344 due to difference in pressures and areas (i.e., pressure difference and area difference).

Surrounding pressure 568 is a pressure outside of and/or surrounding, at least part of chamber 564. In one or more embodiments, surrounding pressure 568 may be the less than, the same as, or greater than chamber pressure 567. In one or more embodiments, the volume surrounding insert valve 238 may be the internal volume of borehole 120 (or any casing thereof). Thus, surrounding pressure 568 may be caused by and equal to the hydrostatic pressure (i.e., "hydrostatic head") in borehole 120 at the depth insert valve 238 is placed. As a non-limiting example, at 3,000 ft depth under a liquid with a density of 150 pounds-per-cubic-foot (lbs/ft$^3$ or pcf), there is a hydrostatic head of approximately 3,140 pounds-per-square-inch (lbs/in$^2$ or psi).

Piston area, generally, is the exposed surface area of piston rod 344 in any given volume. In one or more embodiments, a piston area is equal to the projected area orthogonal to axis of translation 462. Thus, adding texture or cutting piston rod 344 at a non-orthogonal angle would not increase a piston area as only the projected area determines the piston area. In one or more embodiments, two piston areas may be the same on opposite sides of one piston seal 451. Alternatively, one piston rod 344 may have two different piston areas (e.g., as shown in FIG. 5 with piston area X 570X and piston area Z 570Z).

Piston area X 570X is a piston area on one side of piston rod 344. In the example depicted in FIG. 5, piston area X 570X is disposed on the left side of chamber 564. Piston area X 570X may be greater than or less than piston area Z 570Z.

Piston area Z 570Z is a piston area on one side of piston rod 344. In the example depicted in FIG. 5, piston area X 570X is disposed on the right side of chamber 564. Piston area Z 570Z may be greater than or less than piston area X 570X.

Due to the geometry of chamber 564 and piston rod 344 disposed therethrough, a chamber piston force (along axis of translation 462) is applied to piston rod 344 whenever (i) chamber pressure 567 is not equal to surrounding pressure 568, and (ii) piston area X 570X is not equal to piston area Z 570Z. Generally, the chamber piston force exerted on piston rod 344 (and therefore exerted by piston rod 344 to anything coupled thereto) may be described with the following equation (with "left" being negative, and "right" being positive):

$$\text{Chamber Piston Force}=(\text{Piston Area } A-\text{Piston Area } B)\times(\text{Surrounding Pressure}-\text{Chamber Pressure})$$

As a first non-limiting example, consider a scenario where:

a. Piston area X 570X is 3 in$^2$, b. Piston area Z 570Z is 1.5 in$^2$, c. Surrounding pressure 568 is 3,000 psi, and d. Chamber pressure 567 is 3,200 psi.

Thus:

$$F_{net}=(3\ \text{in}^2-1.5\ \text{in}^2)\times(3{,}000\ \text{psi}-3{,}200\ \text{psi}) \quad \text{a.}$$

$$F_{net}=(1.5\ \text{in}^2)\times(-200\ \text{psi}) \quad \text{b.}$$

c. $F_{net}$=−300 lbs=300 lbs to the "left"

As a second non-limiting example, consider a scenario where:

a. Piston area X 570X is 2 in$^2$, b. Piston area Z 570Z is 1 in$^2$, c. Surrounding pressure 568 is 5,000 psi, and d. Chamber pressure 567 is 50 psi.

Thus:

$$F_{net}=(2\ \text{in}^2-1\ \text{in}^2)\times(5{,}000\ \text{psi}-50\ \text{psi}) \quad \text{a.}$$

$$F_{net}=(1\ \text{in}^2)\times(4{,}950\ \text{psi}) \quad \text{b.}$$

c. $F_{net}$=4,950 lbs=4,950 lbs to the "right"

Accordingly, depending on (i) the difference (magnitude and direction) between chamber pressure 567 and surrounding pressure 568, and (ii) the difference (magnitude and direction) between piston area X 570X and piston area Z 570Z, the magnitude and direction of force applied to piston rod 344 may be controlled.

As shown in FIG. 5, chamber piston force may be considered to be a "left" direction (negative) or in a "right" direction (positive). Similarly, in the context of FIGS. 6A-6B, chamber piston force may be considered to be a "downward chamber piston force" or an "upward chamber piston force", depending on the direction of the resultant chamber piston force.

FIGS. 6A-6B

Figure 6A:
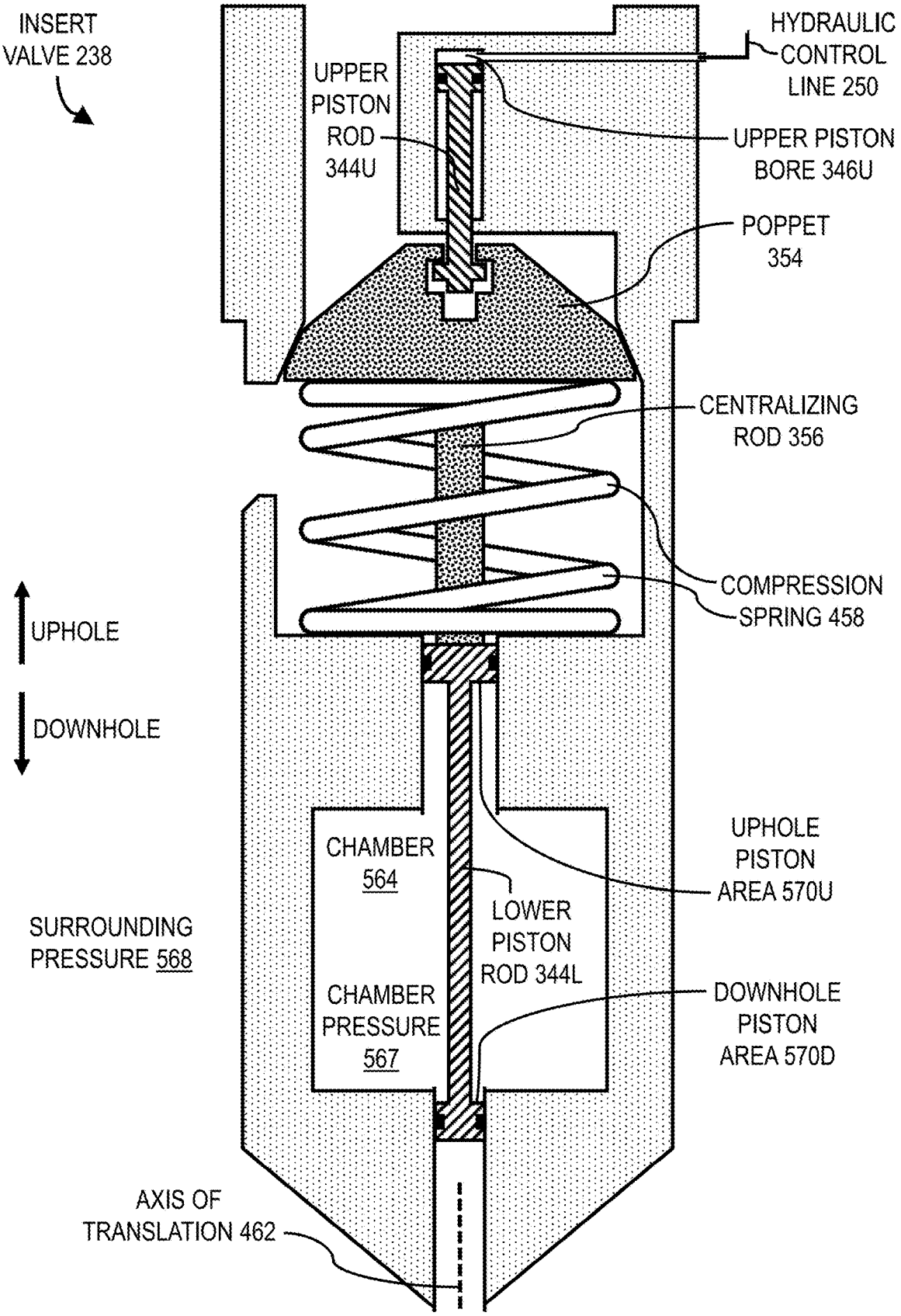
FIG. 6A is a diagram of an insert valve with a chamber in a closed position.
Figure 6B:
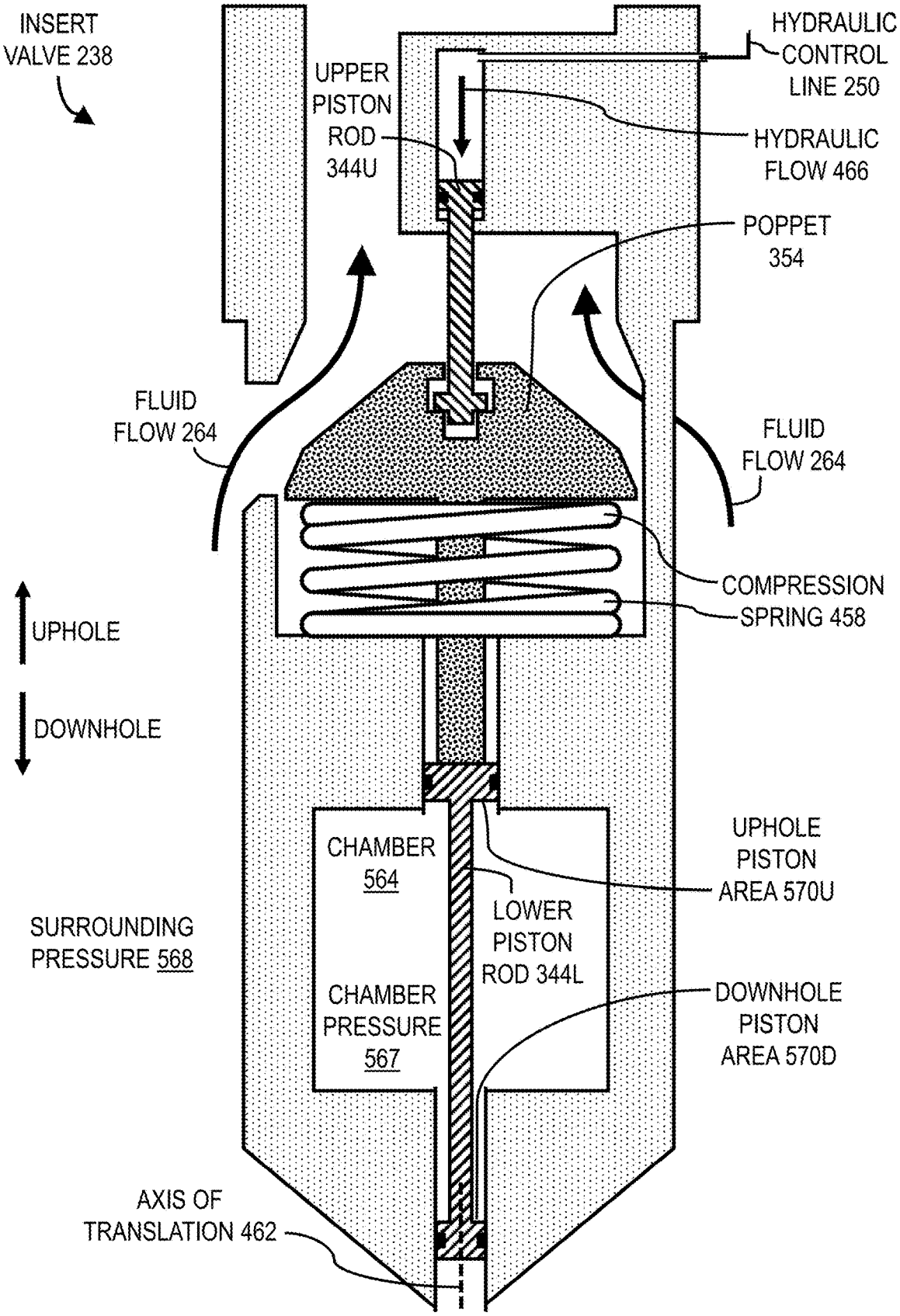
FIG. 6B is a diagram of an insert valve with a chamber in an open position.

FIG. 6A is a diagram of an insert valve with a chamber in a closed position. FIG. 6B is a diagram of an insert valve with a chamber in an open position.

The example embodiments of insert valve 238 shown in FIGS. 6A-6B, may be similar to those shown in FIGS. 4A-4B with the addition of chamber 564 added to the downhole portion of insert valve 238. The description of similar components depicted in FIGS. 6A-6B to those depicted in FIGS. 4A-4B are omitted below. Further, several components of chamber 564 depicted in FIGS. 6A-6B operate similarly to chamber 564 depicted in FIG. 5, and the description of those components is also omitted. Accordingly, only the description of newly introduced components is included below.

In one or more embodiments, where two or more piston rods 344 are disposed within insert valve 238, any one piston rod 344 may be designated as "upper", "uphole", "lower", "downhole", etc. to provide a comparative placement with respect to the other piston rod 344. As shown in FIGS. 6A-6B, lower piston rod 344L may be coupled to centralizing rod 356, while upper piston rod 344U may be coupled to poppet 354.

Upper piston rod 344U is a piston rod (e.g., piston rod 344) disposed further uphole than lower piston rod 344L. In one or more embodiments, upper piston rod 344U may be coupled to poppet 354. Further, the forces on and movement of upper piston rod 344U may be controlled, at least partially, by the pressures in hydraulic control line 250.

Lower piston rod 344L is a piston rod (e.g., piston rod 344) disposed further downhole than upper piston rod 344U. In one or more embodiments, lower piston rod 344L may be coupled to centralizing rod 356. Further, the forces on and movement of lower piston rod 344L may be controlled, at least partially, by chamber pressure 567. In one or more embodiments, the exposed piston areas at each end of lower piston rod 344L are different (e.g., uphole piston area 570U is different than downhole piston area 570D). Lower piston rod 344L may traverse, at least partially, through chamber 564.

Uphole piston area 570U is a piston area on the uphole side of lower piston rod 344L. In one or more embodiments, uphole piston area 570U may be exposed to surrounding pressure 568 on the side coupled to centralizing rod 356. Further, uphole piston area 570U may be exposed to chamber pressure 567, internally in chamber 564, in an uphole opening of chamber 564. As depicted in FIGS. 6A-6B, uphole piston area 570U is shown to be larger than downhole piston area 570D, however one of ordinary skill in the art, provided the benefit of this detailed description, would understand that downhole piston area 570D may be larger than uphole piston area 570U depending on the desired functionality of insert valve 238.

Downhole piston area 570D is a piston area on the downhole side of lower piston rod 344L. In one or more embodiments, downhole piston area 570D may be exposed to surrounding pressure 568 towards the leading downhole side of insert valve 238, in an opening of chamber 564. Further, downhole piston area 570D may be exposed to chamber pressure 567, internally in chamber 564, in a downhole opening of chamber 564.

In one or more embodiments, an "area difference" is the difference in two-dimensional area between a first piston area (e.g., uphole piston area 570U) and a second piston area (e.g., downhole piston area 570D). Similarly, a "pressure difference" is the difference in pressure between a first pressure (e.g., chamber pressure 567) and a second pressure (e.g., surrounding pressure 568).

In one or more embodiments, adding chamber 564 to insert valve 238 allows insert valve 238 to be used at greater range of depths. As a non-limiting example, compression spring 458 may be limited to a maximum size as constrained by the practical inability to install compression spring 458 which is larger and/or able to exert greater upward force on poppet 354. When insert valve 238 is installed below a certain depth, the maximum force exerted by compression spring 458 may be less than the force required to keep poppet 354 closed. That is, there may be a depth limitation to where insert valve 238 (without chamber 564) may be installed, as the hydrostatic head of the liquid prevents compression spring 458 from closing poppet 354. Thus, in such instances, chamber 564 may be installed to exert additional upward force on poppet 354 (via lower piston rod 344L).

Conversely, as another non-limiting example at certain depths, greater pressures coming from the formation may prevent poppet 354 from opening, as too much pressure is applied to the downhole side of insert valve 238 (in a closed state). In such instances, chamber 564 may be installed to exert additional downhole force on poppet 354 (via lower piston rod 344L).

In any embodiment where the depth and pressures of insert valve 238 are, at least, mostly known, chamber 564 (and the components thereof) may be sized and constructed (e.g., by selecting uphole piston area 570U, downhole piston area 570D, and chamber pressure 567). When sized properly, chamber 564 may largely neutralize any additional unwanted forces acting on poppet 354, thereby bringing the chamber piston force on poppet 354 within a desirable range. When in that desirable range, insert valve 238 may be opened and closed via upper piston rod 344U by changes in pressure in hydraulic control line 250 (to upper piston bore 346U). Accordingly, an operator at the surface may open and close insert valve 238, as desired, using hydraulic control line 250.

Solutions and Improvements

The methods and systems described above are an improvement over the current technology as the methods and systems described herein provide an insert valve that allows for improved fluid flow and control.

Generally, when a safety valve loses its ability to properly control the flow of a reservoir's fluid, an insert valve may be installed inside the safety valve, in parallel, to restore proper reservoir fluid control. However, insert valves suffer from reduced flow rates, components that wear similar to the safety valve, depth restrictions, and complicated designs that are prone to higher maintenance and failure.

As discussed herein, an insert valve is provided that allows for fluid flow greater than conventional insert valves by allowing fluid to flow around the closure mechanism then into the internal volume of the insert valve. The piston that controls the closure is constructed in-line and centered with the closure mechanism to provide a simplified design with greater control. Additionally, the piston (and the hydraulic controls therefor) are disposed uphole from the closure mechanism thereby minimizing the number of hydraulic seals installed in the insert valve. Further, the piston may be exposed to the internal volume of the insert valve, at both ends, to neutralize the effect of the pressure on the piston. A pressure chamber may be installed to counteract the forces of a spring mechanism and to allow for control of the insert valve at greater depths.

Additional embodiments include a safety valve with a chamber to further neutralize any unwanted forces acting on the insert valve. The addition of a chamber allows bringing the net forces acting on the insert valve (and the poppet thereof) into a desired range. As the forces on the insert valve may be designed in advance, the insert valve may be controlled via use of the hydraulic control line already present.

Statements

The systems and methods may comprise any of the various features disclosed herein, comprising one or more of the following statements.

Statement 1. An insert valve configured to be installed, at least partially, in a safety valve in a borehole, comprising a flow port disposed on an exterior of the insert valve a poppet configured to control a fluid flow through the flow port an upper piston rod, disposed uphole from the poppet, configured to move the poppet past at least part of the flow port; a chamber, disposed downhole from the poppet, comprising a chamber pressure; a lower piston rod coupled to the poppet, wherein the lower piston rod is configured to exert a chamber piston force on the poppet.

Statement 2. The insert valve of statement 1, wherein the lower piston rod comprises an uphole piston area; a downhole piston area.

Statement 3. The insert valve of statement 2, wherein the chamber piston force exerted by the lower piston rod is caused by an area difference between the uphole piston area and the downhole piston area; a pressure difference between the chamber pressure and a surrounding pressure.

Statement 4. The insert valve of statement 3, wherein the surrounding pressure is caused by a hydrostatic head in the borehole.

Statement 5. The insert valve of statement 4, wherein the chamber pressure is less than the surrounding pressure.

Statement 6. The insert valve of statement 5, wherein the uphole piston area is smaller than the downhole piston area thereby causing the chamber piston force on the poppet to be a downward chamber piston force.

Statement 7. The insert valve of any of statements 5-6, wherein the uphole piston area is greater than the downhole piston area thereby causing the chamber piston force on the poppet to be an upward chamber piston force.

Statement 8. The insert valve of any of statements 4-7, wherein the chamber pressure is greater than the surrounding pressure.

Statement 9. The insert valve of statement 8, wherein the uphole piston area is smaller than the downhole piston area thereby causing the chamber piston force on the poppet to be an upward chamber piston force.

Statement 10. The insert valve of any of statements 8-9, wherein the uphole piston area is greater than the downhole piston area thereby causing the chamber piston force on the poppet to be a downward chamber piston force.

Statement 11. The insert valve of any of statements 3-10, wherein the insert valve further comprises a spring configured to exert an upward force on the poppet.

Statement 12. The insert valve of any of statements 3-11, wherein the insert valve is in hydraulic contact with a hydraulic control line.

Statement 13. The insert valve of statement 12, wherein movement of the upper piston rod may be controlled via a pressure in the hydraulic control line.

Statement 14. The insert valve of statement 13, wherein adding a hydraulic pressure to the hydraulic control line causes the poppet to shift downhole.

Statement 15. The insert valve of any of statements 13-14, wherein removing a hydraulic pressure from the hydraulic control line causes the poppet to shift uphole.

Statement 16. An insert valve installed in a surrounding pressure, comprising a poppet configured to control a fluid flow through a flow port an upper piston rod coupled to the poppet and configured to move the poppet past at least part of the flow port; a lower piston rod coupled to the poppet and configured to exert a chamber piston force on the poppet, wherein the lower piston rod traverses, at least partially, through a chamber.

Statement 17. The insert valve of statement 16, wherein a chamber pressure, in the chamber, causes the chamber piston force.

Statement 18. The insert valve of statement 17, wherein the lower piston rod comprises an uphole piston area; a downhole piston area.

Statement 19. The insert valve of statement 18, wherein the chamber piston force exerted by the lower piston rod is caused by an area difference between the uphole piston area and the downhole piston area; a pressure difference between the chamber pressure and the surrounding pressure.

Statement 20. The insert valve of statement 19, wherein the insert valve is in hydraulic contact with a hydraulic control line.

General Notes

As it is impracticable to disclose every conceivable embodiment of the technology described herein, the figures, examples, and description provided herein disclose only a limited number of potential embodiments. A person of ordinary skill in the relevant art would appreciate that any number of potential variations or modifications may be made to the explicitly disclosed embodiments, and that such alternative embodiments remain within the scope of the broader technology. Accordingly, the scope should be limited only by the attached claims. Further, the compositions and methods are described in terms of "comprising," "containing," or "including" various components or steps, the compositions and methods may also "consist essentially of" or "consist of" the various components and steps. Moreover, the indefinite articles "a" or "an," as used in the claims, are defined herein to mean one or more than one of the elements that it introduces. Certain technical details, known to those of ordinary skill in the relevant art, may be omitted for brevity and to avoid cluttering the description of the novel aspects.

For further brevity, descriptions of similarly named components may be omitted if a description of that similarly named component exists elsewhere in the application. Accordingly, any component described with respect to a specific figure may be equivalent to one or more similarly named components shown or described in any other figure, and each component incorporates the description of every similarly named component provided in the application (unless explicitly noted otherwise). A description of any component is to be interpreted as an optional embodiment-which may be implemented in addition to, in conjunction with, or in place of an embodiment of a similarly-named component described for any other figure.

Lexicographical Notes

As used herein, adjective ordinal numbers (e.g., first, second, third, etc.) are used to distinguish between elements and do not create any ordering of the elements. As an example, a "first element" is distinct from a "second element", but the "first element" may come after (or before) the "second element" in an ordering of elements. Accordingly, an order of elements exists only if ordered terminology is expressly provided (e.g., "before", "between", "after", etc.) or a type of "order" is expressly provided (e.g., "chronological", "alphabetical", "by size", etc.). Further, use of ordinal numbers does not preclude the existence of other elements. As an example, a "table with a first leg and a second leg" is any table with two or more legs (e.g., two legs, five legs, thirteen legs, etc.). A maximum quantity of elements exists only if express language is used to limit the upper bound (e.g., "two or fewer", "exactly five", "nine to twenty", etc.). Similarly, singular use of an ordinal number does not imply the existence of another element. As an example, a "first threshold" may be the only threshold and therefore does not necessitate the existence of a "second threshold".

As used herein, the term "operative connection" (or "operatively connected") means the direct or indirect connection between devices that allows for the transmission of data. For example, the phrase 'operatively connected' may refer to a direct connection (e.g., a direct wired or wireless connection between devices) or an indirect connection (e.g., multiple wired and/or wireless connections between any number of other devices connecting the operatively connected devices).

As used herein, indefinite articles "a" and "an" mean "one or more". That is, the explicit recitation of "an" element does not preclude the existence of a second element, a third element, etc. Further, definite articles (e.g., "the", "said") mean "any one of" (the "one or more" elements) when referring to previously introduced elements. As an example, there may exist "a processor", where such a recitation does not preclude the existence of any number of other processors. Further, "the processor receives data, and the processor processes data" means "any one of the one or more processors receives data" and "any one of the one or more processors processes data". It is not required that the same processor both (i) receive data and (ii) process data. Rather, each of the steps ("receive" and "process") may be performed by different processors.

As used herein, "machine" means any collection of components assembled to form a tool, structure, or other apparatus. A collection of components may be grouped together and referred to as a single 'machine' based on the functionality of the machine enabled by the combination of the components. As a non-limiting example, a "car engine" is a machine assembled from the components of an engine block, one or more pistons, a camshaft, etc. that, when combined, function to convert chemical energy into mechanical energy. Further, a machine may be constructed using one or more other machines. As a non-limiting example, an automobile may be an assembly of a car engine, a drivetrain, and a steering system—each an independent machine—but assembled to form a larger machine, singularly referred to as an "automobile", which functions to provide transportation.

As used herein, "upward" means in an "uphole" direction and "downward" means in a "downhole" direction. Further, "uphole" refers to an area of the borehole that is more proximate to the surface (when navigating through the borehole) than a "downhole" area of the borehole. That is, although a borehole may vary in depth and come (relatively) "closer" to the surface, a section is only considered "uphole" when traveling along the path of the borehole.

What is claimed is:

1. An insert valve configured to be installed, at least partially, in a safety valve in a borehole, comprising:
- a flow port disposed on an exterior of the insert valve;
- a poppet configured to control a fluid flow through the flow port;
- an upper piston rod, disposed uphole from the poppet, configured to move the poppet past at least part of the flow port; and
- a chamber, disposed downhole from the poppet, comprising:
  - a chamber pressure; and
  - a lower piston rod coupled to the poppet,
    - wherein the lower piston rod comprises:
      - an uphole piston area; and
      - a downhole piston area,
    - wherein the lower piston rod is configured to exert a chamber piston force on the poppet, and
    - wherein the chamber piston force exerted by the lower piston rod is caused by:
      - an area difference between the uphole piston area and the downhole piston area.

2. The insert valve of claim 1, wherein the chamber piston force exerted by the lower piston rod is further caused by:
- a pressure difference between the chamber pressure and a surrounding pressure.

3. The insert valve of claim 2, wherein the surrounding pressure is caused by a hydrostatic head in the borehole.

4. The insert valve of claim 3, wherein the chamber pressure is less than the surrounding pressure.

5. The insert valve of claim 4, wherein the uphole piston area is smaller than the downhole piston area thereby causing the chamber piston force on the poppet to be a downward chamber piston force.

6. The insert valve of claim 4, wherein the uphole piston area is greater than the downhole piston area thereby causing the chamber piston force on the poppet to be an upward chamber piston force.

7. The insert valve of claim 3, wherein the chamber pressure is greater than the surrounding pressure.

8. The insert valve of claim 7, wherein the uphole piston area is smaller than the downhole piston area thereby causing the chamber piston force on the poppet to be an upward chamber piston force.

9. The insert valve of claim 7, wherein the uphole piston area is greater than the downhole piston area thereby causing the chamber piston force on the poppet to be a downward chamber piston force.

10. The insert valve of claim 2, wherein the insert valve further comprises a spring configured to exert an upward force on the poppet.

11. The insert valve of claim 2, wherein the insert valve is in hydraulic contact with a hydraulic control line.

12. The insert valve of claim 11, wherein movement of the upper piston rod may be controlled via a pressure in the hydraulic control line.

13. The insert valve of claim 12, wherein adding a hydraulic pressure to the hydraulic control line causes the poppet to shift downhole.

14. The insert valve of claim 12, wherein removing a hydraulic pressure from the hydraulic control line causes the poppet to shift uphole.

15. An insert valve installed in a surrounding pressure, comprising:
- a poppet configured to control a fluid flow through a flow port;
- an upper piston rod coupled to the poppet and configured to move the poppet past at least part of the flow port; and
- a lower piston rod coupled to the poppet and configured to exert a chamber piston force on the poppet, wherein the lower piston rod traverses, at least partially, through a chamber,
- wherein the lower piston rod comprises:
  - an uphole piston area; and
  - a downhole piston area
- wherein a chamber pressure, in the chamber, causes the chamber piston force, and
- wherein the chamber piston force exerted by the lower piston rod is caused by:
  - an area difference between the uphole piston area and the downhole piston area.

16. The insert valve of claim 15, wherein the chamber piston force exerted by the lower piston rod is further caused by:
- a pressure difference between the chamber pressure and the surrounding pressure.

17. The insert valve of claim 16, wherein the insert valve is in hydraulic contact with a hydraulic control line.

18. A method, comprising:

disposing an insert valve into a borehole with a surrounding pressure, wherein the insert valve comprises:

a poppet configured to control a fluid flow through a flow port;

an upper piston rod coupled to the poppet and configured to move the poppet past at least part of the flow port; and a lower piston rod coupled to the poppet and configured to exert a chamber piston force on the poppet, wherein the lower piston rod traverses, at least partially, through a chamber, wherein the lower piston rod comprises:

an uphole piston area; and a downhole piston area wherein a chamber pressure, in the chamber, causes the chamber piston force, and wherein the chamber piston force exerted by the lower piston rod is caused by:

an area difference between the uphole piston area and the downhole piston area; and actuating the upper piston rod to move the poppet to control the fluid flow through the flow port.

19. The method of claim 18, wherein actuating the upper piston rod comprises:

supplying a hydraulic pressure to a hydraulic control line in fluid communication with the upper piston rod to move the poppet downhole.

20. The method of claim 19, wherein after supplying the hydraulic pressure to the hydraulic control line, the method further comprises:

removing the hydraulic pressure from the hydraulic control line to move the poppet uphole.

* * * * *